United States Patent [19]

Barnes

[11] Patent Number: 4,531,448

[45] Date of Patent: Jul. 30, 1985

[54] BALANCED OUTPUT HYDRAULIC ACTUATOR SYSTEM

[75] Inventor: Philip E. Barnes, West Hartford, Conn.

[73] Assignee: United Technologies Corporation, Hartford, Conn.

[21] Appl. No.: 609,915

[22] Filed: May 14, 1984

[51] Int. Cl.[3] ..... F15B 9/10

[52] U.S. Cl. ..... 91/384; 91/509

[58] Field of Search ..... 91/384, 509, 510, 171

[56] References Cited

U.S. PATENT DOCUMENTS

| | | | |
|---|---|---|---|
| 2,706,886 | 4/1955 | Michel | 60/35.6 |
| 2,729,943 | 1/1956 | Clarke et al. | 91/171 |
| 2,859,591 | 11/1958 | Zimmerman | 91/171 |
| 3,272,062 | 9/1966 | Flippo et al. | 91/384 |
| 3,677,137 | 7/1972 | Stockwell | 91/6 |
| 3,726,186 | 4/1973 | Wheeler et al. | 91/384 |
| 4,231,284 | 11/1980 | Smith et al. | 91/171 |

FOREIGN PATENT DOCUMENTS 652001 4/1951 United Kingdom .

*Primary Examiner*—Paul E. Maslousky
*Attorney, Agent, or Firm*—John Swiatocha

[57] ABSTRACT

A system (10) of parallel hydraulic actuators (15) and (20) includes a pair of laterally spaced, longitudinally extending, discrete feedback levers (180) and (185) which independently provide feedback signals to a pair of actuator control valves (50) and (55) with enhanced accuracy and minimal lateral loading of the system.

5 Claims, 8 Drawing Figures

BALANCED OUTPUT HYDRAULIC ACTUATOR SYSTEM

DESCRIPTION

1. Technical Field

This invention relates generally to hydraulic actuator systems and, more particularly, to hydraulic actuator systems employing multiple actuators connected in parallel.

2. Background Art

Hydraulic actuators, particularly those used to position such actuated devices as control surfaces in aircraft, are frequently employed in pairs, each actuator of a pair being capable of independently positioning the device, whereby control thereof by one of the actuators is preserved despite failure of the other actuator. Actuator pairs are also required where a single actuator alone may not be capable of an output force sufficient to move the actuated device. In either case, it is important that mismatch between the outputs of the actuators be minimized. In other words, the actuator strokes should be uniform. Where the actuators are rigidly connected in parallel, juxtaposed orientation, such mismatch in actuator output results in unequal load sharing by the actuators in the system, and lateral deflection of the actuator system as a whole. Those skilled in the art will appreciate that unequal load sharing excessively stresses the actuator(s) which support the greater portion of the load while lateral deflection of the system not only mechanically loads the actuators in a manner which makes no contribution to a useful output thereof, but also tends to cause binding of the actuator pistons within the cylinders, and thus adversely affects the reliability and useful life of the actuators.

For the most part, output mismatch between rigidly connected hydraulic actuators is due to disparities in the pressurization thereof. Typically, the pressurization of each actuator of the system is controlled by an associated control valve which selectively ports pressurized hydraulic fluid to one side of the actuator piston while draining fluid from the opposite side thereof. The actuator is usually mechanically connected to the valve so that required movement of the actuator effects nulling of the valve to shut off further actuator pressurization and drainage. Where the actuator system operates an aircraft flight control surface, such control valves have very high pressure gains associated with them. That is, miniscule changes in valve settings effect extremely great changes in actuator pressurization and, therefore, actuator output. In fact, the gain associated with such control valves is quite often high enough to cause a force fight between a pair of nulled actuators wherein the actuators are oppositely pressurized so that one of the actuators is pressurized toward extension while the other is pressurized toward retraction. This of course, loads the actuators in a manner which makes no useful contribution to the output of the actuator system and inhibits actuator response to input signals, since actuator output must correct missettings of the control valves before performing any useful work.

In the prior art, various techniques have been employed in efforts to impart balanced operation to multiple actuator systems. One such technique involves the use of additional hydraulic control apparatus, otherwise known as "pressure synchronization systems", to counteract the disparity in actuator pressurization by the control valves. In U.S. Pat. No. 4,231,284 to Smith et al, an actuator pair is provided with a specialized linkage employing a single feedback lever which laterally deforms upon lateral deflection of the actuator pair to readjust the control valves for equalized actuator pressurization. While such a technique may be preferred over pressure synchronization systems to enhance balanced actuator operation, a single feedback lever may be inappropriate where redundant feedback to the actuators is required. Furthermore, the Smith et al linkage must tolerate substantial lateral loading and deformation thereof for proper operation. Where such loading and/or deformation is intolerable, alternatives to the Smith et al system are desirable. Enhanced accuracy in balancing actuator pressurization by the control valves is continually sought, and achieved by the invention herein.

DISCLOSURE OF INVENTION

It is an object of the present invention to provide an improved system of rigidly connected, parallel hydraulic actuators.

It is another object of the present invention to provide such an hydraulic actuator system characterized by an enhanced uniformity in the output of the actuators employed therein.

It is another object of the present invention to provide such an hydraulic actuator system with a redundancy in feedback between the actuators and the valves which control the pressurization thereof.

It is another object of the present invention to provide such an hydraulic actuator system wherein lateral loading of the system due either to imbalanced operation of the actuators or in the application of a mechanical feedback signal from the actuators to the control valves therefor is minimized.

It is yet another object of the present invention to provide such an hydraulic actuator system characterized by enhanced accuracy of operation and simplicity of construction.

These and other objects are achieved by the present invention wherein each of a pair of rigidly connected, parallel hydraulic actuators in a system thereof is provided with a generally longitudinally oriented, discrete feedback lever which independently applies a mechanical feedback signal from the actuator to an associated control valve, thereby adjusting the control valve in such a manner as to minimize imbalances between the actuators while substantially reducing the lateral loading thereof and the linkages associated therewith. Since lateral loading of the linkages is reduced, the accuracy of the feedback signals applied to the control valves from the associated actuators is enhanced. Furthermore, since independent feedback levers are used, inoperability of one of the feedback linkages will not adversely affect the operation of any other linkage, actuator, or control valve. In the preferred embodiment, the feedback levers are pivotally connected at laterally spaced, adjacent ends thereof to the ends of the actuator piston rods. The opposite ends of the feedback levers are connected to a pair of discrete idler levers pivotally mounted to the actuator cylinders. An input linkage is also connected to the idler levers and connects the control valves with a means for applying a mechanical input signal thereto. The idler levers are provided with a pair of interengaging arms appended thereto and extending inwardly therefrom, the interengaged arms enhancing the lateral strength of the actuator linkage.

The free ends of the arms may be pinned together to allow limited relative pivotal movement therebetween.

BEST MODE FOR CARRYING OUT THE INVENTION

Figure 3:
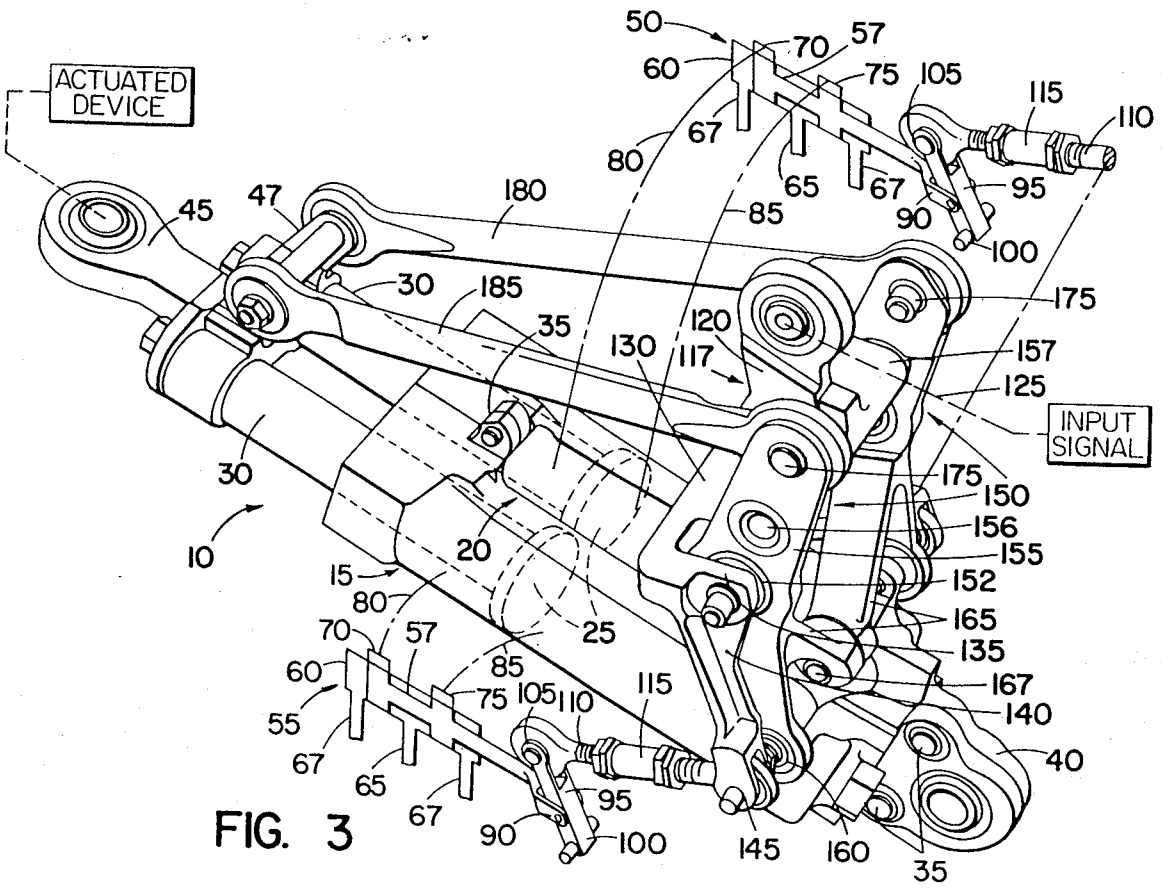
FIG. 3 is an isometric view of the actuator system, schematically showing details of the fluid connections between the actuators and associated control valves employed therewith, the system being shown in a balanced mode of operation.
Figure 5:
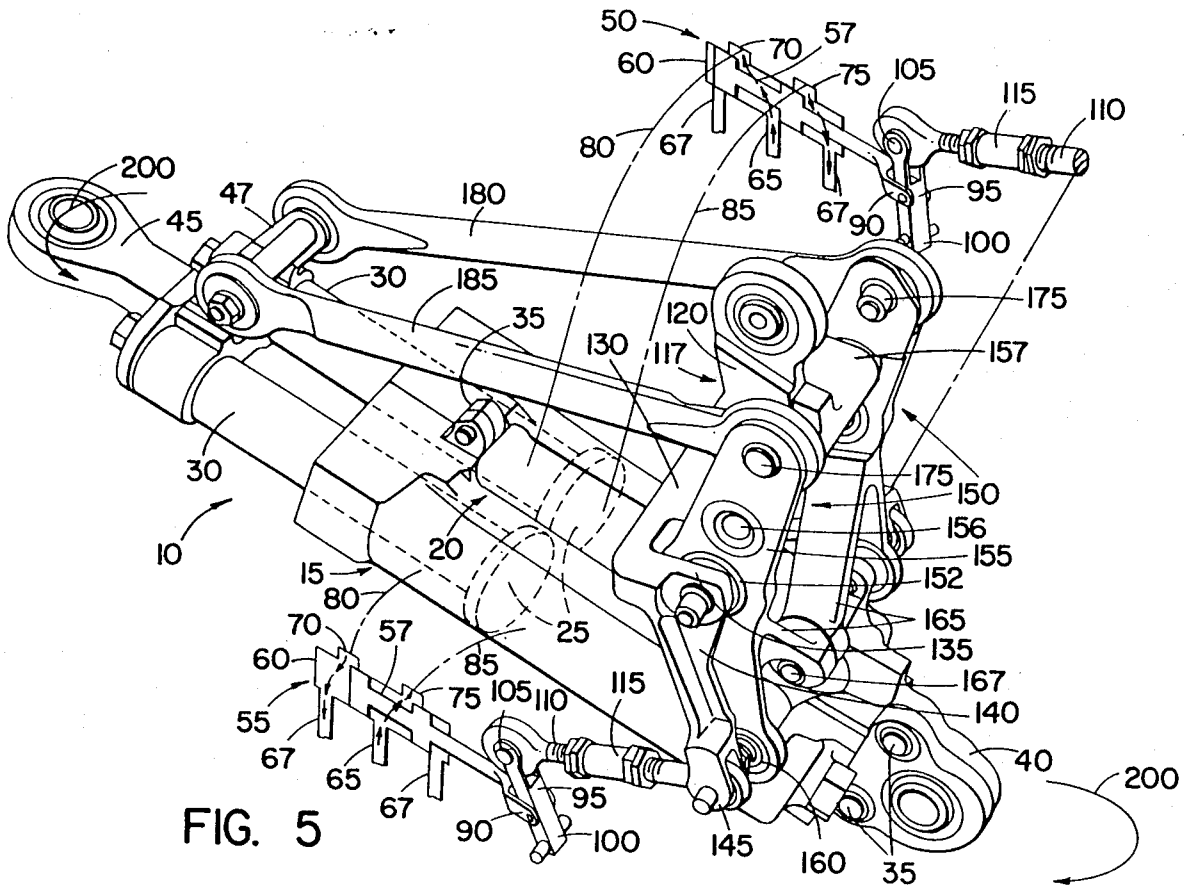
FIG. 5 is an isometric view similar to FIG. 3, but instead, showing the actuator system in an imbalanced mode of operation being corrected by feedback to hydraulic control valves employed in the system.
Figure 7:
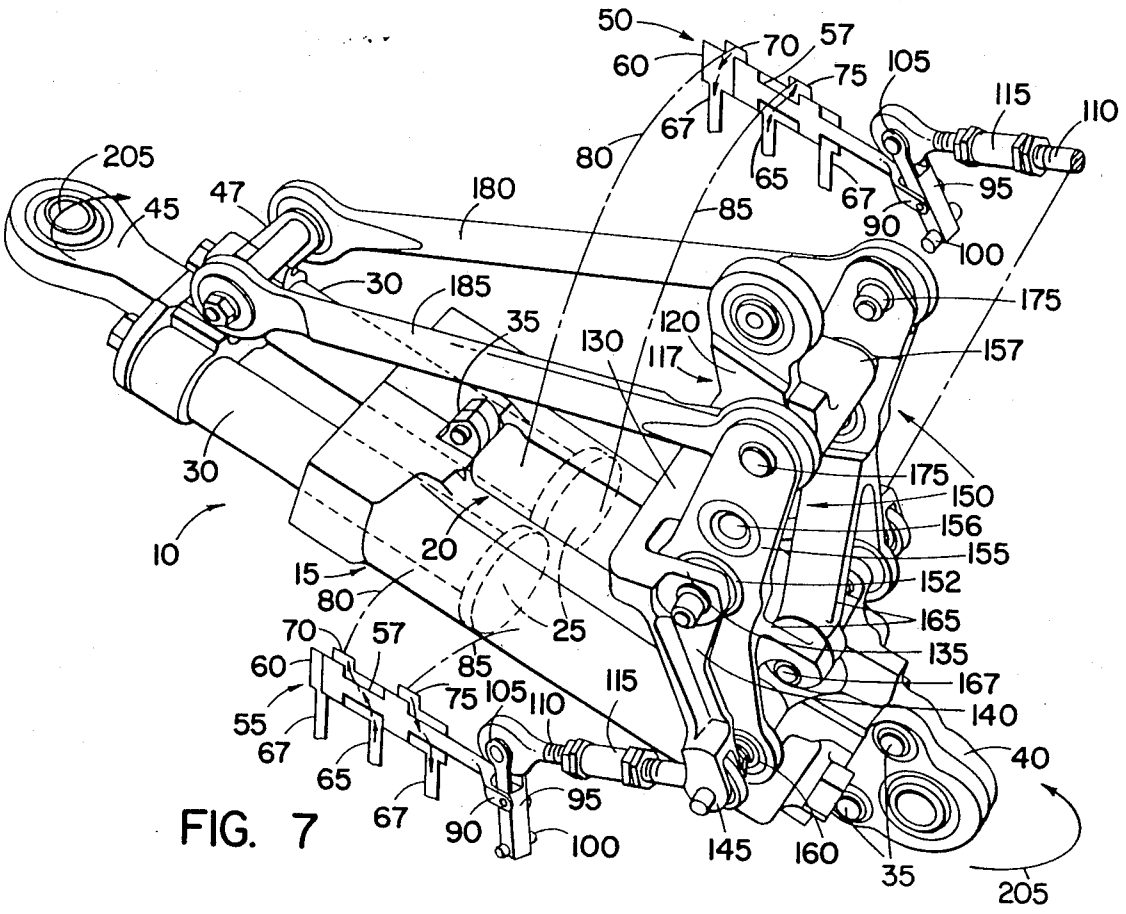
FIG. 7 is an isometric view similar to FIG. 5, but showing the system in an opposite mode of imbalance being corrected by feedback applied to the hydraulic control valves.

Referring to the drawings, the hydraulic actuator system of the present invention shown generally at 10 comprises a pair of parallel, juxtaposed hydraulic actuators 15 and 20. For purposes of discussion, it will be assumed that as best seen in FIGS. 3, 5 and 7, each actuator comprises an hydraulic cylinder enclosing a reciprocally displaceable piston 25 and connecting rod 30, the connecting rods comprising the actuator output member. Both hydraulic cylinders may be integrally formed into a single component as by casting or forging, followed by machining, or formed separately by such techniques and fixed together such as at bolted connections 35. End 40 of the actuator pair comprises an apertured lug by which the actuator system is grounded by, for example, an appropriately sized clevis connector (not shown). The free ends of connecting rods 30 are joined by a second lug 45 having laterally spaced upstanding arms 47 provided thereon. The apparatus which actuator system 10 operates is connected to the system at lug 45.

Figure 1:
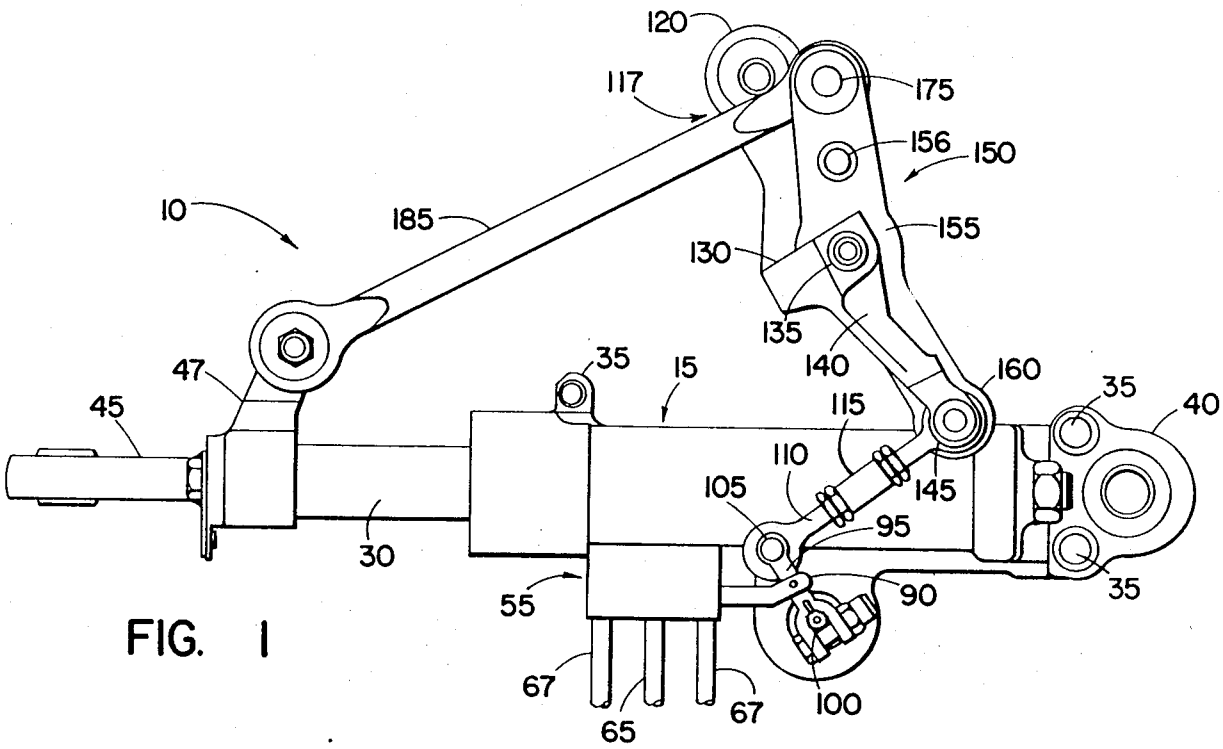
FIG. 1 is a side elevation of the actuator system of the present invention.
Figure 2:
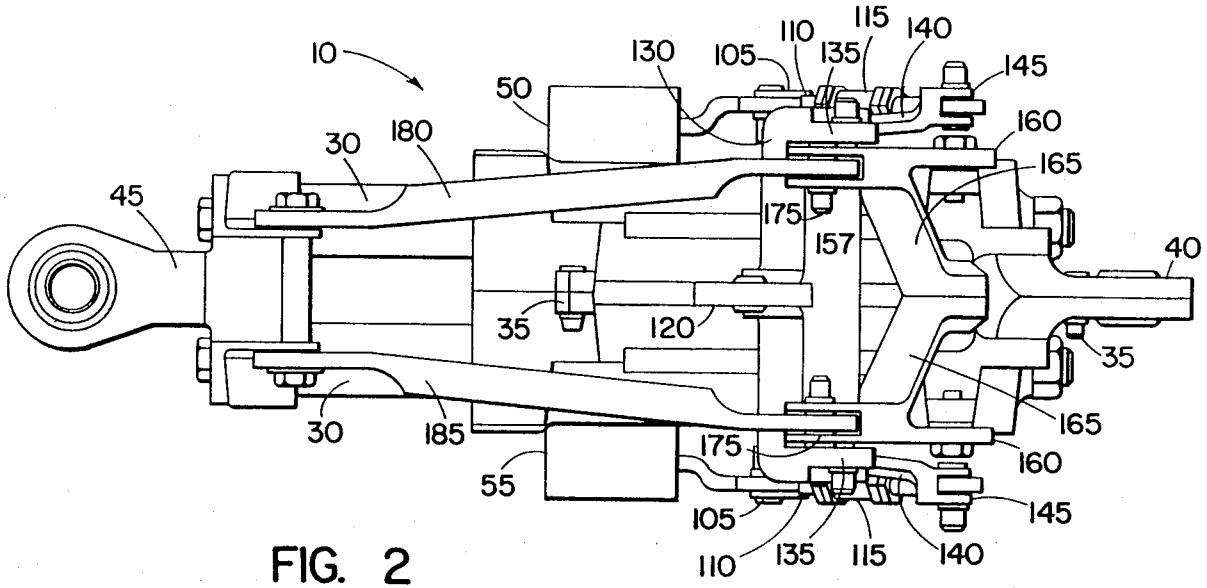
FIG. 2 is a top plan view of the actuator system.

Those skilled in the art will appreciate that actuators 15 and 20 function in normal fashion, pressurization of the right-hand ends (as viewed in FIGS. 3, 5 and 7) of the cylinders being accompanied by draining of the left-hand ends thereof, causing the actuators to extend such that the piston rods and lug 45 move outwardly. Similarly, pressurization of the left-hand ends of the cylinders accompanied by draining of the right-hand ends thereof cause the actuators to retract whereby the piston rods and lug 45 move inwardly. The pressurization and drainage of actuators 15 and 20 are controlled by control valves 50 and 55, respectively, each including a spool 57 slidably received within a housing 60 provided with an inlet 65, drains 67 and outlets 70 and 75. Outlets 70 communicate with the left-hand (outer) ends of actuators 15 and 20 by means of fluid lines 80 while outlets 75 of the control valves communicate with the opposite ends of actuators 15 and 20 through lines 85. As shown in FIGS. 1 and 2, the valve housings may be formed integrally with the actuator cylinders although this is not a requirement of the present invention.

Corresponding ends of the control valve spools terminate in clevises 90 pivotally connected to medial portions of links 95 which are pivotally grounded to the actuator cylinders at 100. The opposite ends of links 95 terminate in clevises 105 which pivotally connect to links 110. As shown, links 110 are adjustable in length, each being provided with a turnbuckle 115 and connect links 95 with an input linkage 117. Input linkage 117 comprises a single multi-armed lever comprising an upstanding arms 120 to which mechanical input signals to the actuator system are applied, as by a linkage indicated schematically by dashed line 125. Arm 120 terminates at a lower portion thereof at integral transverse arms 130 terminating themselves in clevises 135 and integral downwardly extending arms 140. Arms 140 terminate in clevises 145 which pivotally connect to links 110. Clevises 135 connect pivotally to idler linkage 150 at anti-friction bearing 152, the idler linkage comprising a pair of idler levers 155. A pin 156 received within housing portion 157 of input linkage 117 extends loosely through idler levers 150 to limit the input stroke of linkage 117 by limiting the pivotal movement thereof relative to the idler levers. Each idler lever is pivotally grounded to a respective one of the cylinders at 160 and is provided with an inwardly extending oblique arm 165 appended thereto. Arms 165 are pinned or otherwise pivotally connected together at 167 to impart enhanced lateral strength to the idler linkage. The connections of the idler arms to the cylinders and pivotable connection 167 between arms 165 are coaxial. Idler levers 155 terminate at the upper portions thereof at pivotal connections 175 with the ends of first and second laterally spaced discrete feedback levers 180 and 185, the opposite ends of the feedback levers being pivotally connected to upstanding arms 47 on lug 45.

Figure 4:
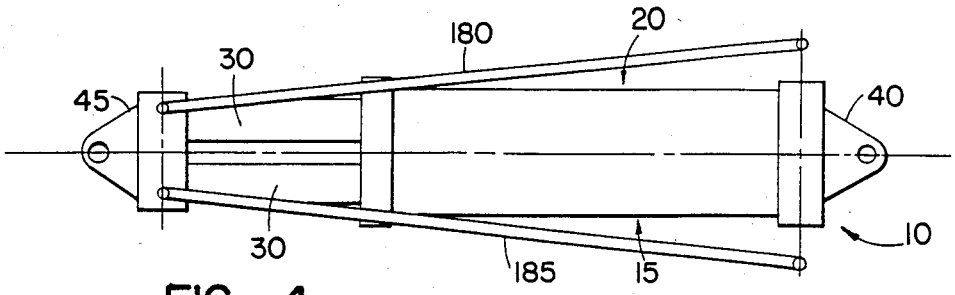
FIG. 4 is a simplified, top plan view of the actuators and feedback linkage shown in FIG. 3.

Assuming for purposes of illustration, that actuator system 10 remains balanced, operation of the system is as follows. Referring to FIGS. 3 and 4, a mechanical input signal is applied to input linkage 117 by means of linkage 125. This rotates input linkage 117 about the connection thereof with idler linkage 150 at clevises 135. Such rotation moves adjustable links 110 axially, thereby rotating links 95 about grounded connections 100 thereof, and adjusting the position of the control valve spools. Such adjustment from the positions shown in FIG. 3, increases the pressure in corresponding ends of actuators 15 and 20 and decreases the pressure in the opposite ends thereof by draining, thereby causing movement of piston rods 30 and thus, lug 45 to move the actuated device. Such movement either pulls or pushes feedback levers 180 and 185 thereby rotating idler levers 155 about the grounded connection thereof with the actuator cylinders, and pivoting input linkage 117 about its connection with lever 125. Such movement of the input linkage moves links 110 and links 95 to reposition the control valve spools thereby nulling the control valves as shown in FIG. 3 to block any further pressurization or draining of the cylinders through lines 80 and 85 when the required movement of connecting rods 25 and 30 has been achieved.

Figure 6:
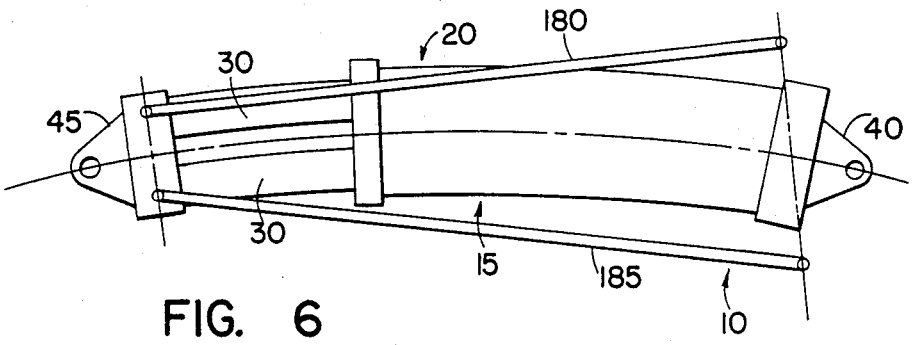
FIG. 6 is a simplified, top plan view of the actuators and feedback linkage shown in FIG. 5.
Figure 8:
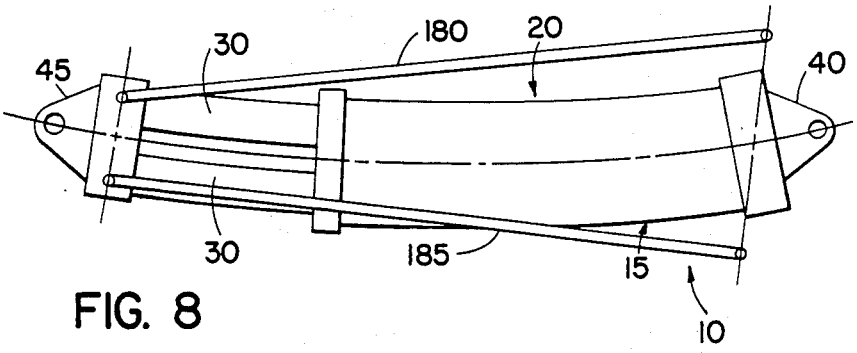
FIG. 8 is a simplified, top plan view of the actuators and feedback linkage illustrated in FIG. 7.

As set forth hereinabove, due to manufacturing tolerances, force (output) mismatch between the actuators and the drawbacks attendant therewith are inevitable, as are force fights between the actuator pair when nulled. Actuator output mismatch or force fighting is schematically illustrated in FIGS. 5–8. As set forth hereinabove, output mismatch in actuator systems such as that illustrated herein is the result of disparities in the pressurization of the actuators. A force fight between parallel actuators in such a system can, for purposes of illustration, be viewed as an extreme case of output mismatch between actuators. A force fight in an otherwise nulled actuator pair would occur when the control valves are misadjusted from their nulled positions to pressurize and drain opposed ends of the actuators. In other words, one end of one of the actuators is pressurized while the corresponding end of the other actuator is drained. Such a situation is illustrated in FIG. 6 wherein the spool of valve 55 has been misadjusted from its nulled position to cause pressurization of the left-hand end of cylinder 20 and draining of the right-hand end thereof. Likewise, control valve 50 has been misadjusted from its nulled position to pressurize the right-hand end of actuator 15 while draining the left-hand end thereof. Such opposite pressurization of the actuators results in reactive moments illustrated by arrows 200 (FIG. 5) to be applied to the actuator system from the actuated apparatus and ground at 40 causing the entire system to flex in the manner illustrated. Likewise, an opposite misadjustment of valves 55 and 60 from their nulled positions pressurizes the actuators in an opposite manner applying moments to the system in the direction of arrows 205 in FIG. 7, thereby causing the system to flex in the manner illustrated in FIG. 8. The flexures of the system shown in FIGS. 6 and 8 are exagerated for purposes of illustration and discussion.

In the prior art, schemes such as pressure synchronization systems and deformable feedback linkages have been employed in efforts to maintain uniform pressurization and system output in the face of tendencies toward output mismatch and force fighting. By the present invention, the shortcomings discussed hereinabove of such prior art systems have been avoided with the provision of independent, generally longitudinally extending, laterally spaced discrete feedback levers 180 and 185. With reference to FIGS. 5 and 6, under the conditions of system flexure illustrated in FIG. 6, feedback lever 180 is pushed generally longitudinally to the left while feedback lever 185 is drawn longitudinally to the right with respect to the system connection points. Such movement pivots the idler levers in opposite directions thereby readjusting the control valves 55 and 60 by virtue of the connection of the valves to the idler levers through links 95 and 110 and arms 140 of input linkage 117. Such adjustment is manifested by movement of the valve elements of control valve 50 to the left and movement of the valve element of control valve 55 to the right. This effects settings of the control valves illustrated in FIG. 5 to reduce the pressure of the pressurized actuator ends and increase the pressure of the drained actuator ends thereby minimizing the force fight between the actuators and hence, reducing system flexure. Those skilled in the art will note that system flexure is minimized in quite the same way under the conditions illustrated in FIGS. 7 and 8.

It will be appreciated then that with independent, laterally spaced, discrete feedback levers, readjustment of the control valves from mismatched settings thereof is achieved without collateral pressure synchronization systems and without laterally deforming any of the linkages employed in the actuator system for enhanced accuracy and repeatability of operation. Furthermore, independent feedback levers also provide the system with a measure of redundancy lacking in prior art system employing a single, laterally deformable feedback linkage. While the opposite rotations of the idler arms will cause a slight pivoting of the input linkage in a plane parallel to the longitudinal axis of the system, such pivoting is miniscule in magnitude and easily accommodated by the antifriction bearings at the connections of the idler arms to the input linkage. Similarly, free play or antifriction bearings (if provided) in the connections between the feedback levers and lug 45 and the connections between the feedback levers and the idler linkage accommodate pivotal movement between those members in planes parallel to the longitudinal axis of the system. Although no lateral deformation of any of the linkages is required in the operation of this system, the system does experience some lateral loading prior to readjustment of the control valves by the feedback levers. To strengthen the linkage against such loading, arms 165 depending from idler levers 155 compressively interengage one another to react such loading without any substantial deformation of any of these system components. The pinned connection between the arms allows the necessary relative pivotal movement therebetween which results from the oppositely directed pivotal movement of the idler arms due to the oppositely directed longitudinal movement of the feedback levers. However, such pivotal movement between the idler arms is held to a minimum by the coaxial disposition of the pinned connection of the arms and the grounded connections 160 of the main idler levers to the actuator cylinders. This, pivotal movement is of such a slight magnitude that the connection of arms 165 to one another can be made by a simple pin without necessitating a rotary bearing.

While a particular embodiment of the present invention has been described and illustrated, it will be understood that various modifications will, from the description and illustrations herein, suggest themselves to those skilled in the art. For example, while particular pivotal connections and component shapes are shown, it will be understood that other equivalent pivotal connections and components shapes either are also contemplated. It is intended by the following claims to cover all such modifications as fall within the true spirit and scope of this invention.

Having thus described the invention, what is claimed is:

1. In an hydraulic actuator system comprising a pair of parallel hydraulic actuators, each actuator comprising a cylinder rigidly connected to the cylinder of the other actuator and an output member reciprocally displaceable with respect to the cylinder and rigidly connected to the output member of the other actuator;

said actuator system further comprising a pair of control valves, each controlling the pressurization of an associated actuator;

an idler linkage;

an input linkage connected to said control valves and to said idler linkage for movement thereon, said input linkage being adapted for simultaneously applying an input signal to each of said control valves; and a feedback linkage connected to said output members and to said idler linkage for applying a feedback signal to said control valves by means of said idler and input linkages in response to movement of said output members; said hydraulic actuator system being characterized by:

said idler linkage comprising first and second independently movable, discrete idler levers pivotally grounded to said first and second actuators, respectively;

said feedback linkage comprising first and second laterally spaced, discrete feedback levers pivotally connected to both said first and second idler levers, respectively, and to said output members;

whereby imbalanced operation of said actuator system resulting in longitudinal displacement of said connected output members effects independent longitudinal displacement of said feedback levers relative to one another for independent, redundant application of said feedback signals to said control valves with enhanced accuracy and predictability and reduced linkage stress.

2. The hydraulic actuator system of claim 1 characterized by said output members comprising a pair of generally parallel piston rods connected at adjacent ends thereof by a coupling, said feedback levers being pivotally connected to said coupling at laterally spaced locations thereon.

3. The hydraulic actuator system of claim 1 characterized by each of said idler levers including an inwardly extending arm appended thereto, said idler levers being connected at corresponding ends thereof to said hydraulic cylinders and said arms being interconnected at free ends thereof for compressive interengagement with one another when said idler linkage is laterally loaded for imparting enhanced lateral strength thereto.

4. The hydraulic actuator system of claim 3 characterized by the interengagement of said idler lever arms and the locations of said connections of said idler levers to said actuator cylinders being generally coaxial.

5. The hydraulic actuator system of claim 3 characterized by a bearingless, pivotal interconnection between said idler lever arms which allows limited relative pivotal movement therebetween.

* * * * *